US010935288B2

(12) United States Patent
Rhee et al.

(10) Patent No.: US 10,935,288 B2
(45) Date of Patent: Mar. 2, 2021

(54) CONDENSER

(71) Applicant: Hanon Systems, Daejeon (KR)

(72) Inventors: Sang Yong Rhee, Daejeon (KR); Jun-Il Jang, Daejeon (KR); Seong Hun Kim, Daejeon (KR); Hyun Keun Shin, Daejeon (KR)

(73) Assignee: Hanon Systems, Daejeon (KR)

( * ) Notice: Subject to any disclaimer, the term of this patent is extended or adjusted under 35 U.S.C. 154(b) by 98 days.

(21) Appl. No.: 16/113,054

(22) Filed: Aug. 27, 2018

(65) Prior Publication Data

US 2019/0063800 A1 Feb. 28, 2019

(30) Foreign Application Priority Data

Aug. 28, 2017 (KR) ..... 10-2017-0108725
Jun. 20, 2018 (KR) ..... 10-2018-0070622
Jun. 26, 2018 (KR) ..... 10-2018-0073424

(51) Int. Cl.
*F25B 39/00* (2006.01)
*F25B 39/04* (2006.01)
*F25B 40/02* (2006.01)

(52) U.S. Cl.
CPC ..... *F25B 39/00* (2013.01); *F25B 39/04* (2013.01); *F25B 40/02* (2013.01); *F25B 2339/043* (2013.01); *F25B 2339/044* (2013.01); *F25B 2339/047* (2013.01); *F25B 2400/23* (2013.01)

(58) Field of Classification Search
CPC ..... F25B 39/00; F25B 39/04; F25B 40/02; F25B 2339/044; F25B 2339/043; F25B 2339/047; F25B 2400/23; F28F 3/08; F28F 3/12; F28D 9/005; F28D 2021/0084
See application file for complete search history.

(56) References Cited

U.S. PATENT DOCUMENTS 7,859,845 B2 * 12/2010 Ullman ..... F28D 9/005 361/699
9,109,840 B2 * 8/2015 Kadle ..... F25B 30/02
9,618,280 B2 * 4/2017 Magnier-Cathenod ..... F28D 9/005
9,810,182 B2 * 11/2017 Amaral ..... F01M 5/002
10,066,878 B2 * 9/2018 Huang ..... B60H 1/00342
10,151,541 B2 * 12/2018 Kim ..... F28D 9/005
10,260,817 B2 * 4/2019 Fetzer ..... F28D 9/0093
10,352,598 B2 * 7/2019 Szostek ..... F25B 40/02
(Continued)

FOREIGN PATENT DOCUMENTS

JP 3355844 B2 12/2002
JP 2016504557 A 2/2016
(Continued)

*Primary Examiner* — Kun Kai Ma
(74) *Attorney, Agent, or Firm* — Norton Rose Fulbright US LLP; James R. Crawford

(57) ABSTRACT

The present invention relates to a condenser, and more particularly, to a condenser in which a configuration and an assembly are simplified by forming a condensation region in which plates are stacked and refrigerant is condensed and a super cooling region in which the refrigerant is supercooled, arranging a connection plate to which a gas-liquid separator is coupled between the condensation region and the super cooling region, and forming the refrigerant and cooling water to flow between the condensation region and the super cooling region, in a water cooling condenser.

18 Claims, 13 Drawing Sheets

(56) References Cited

U.S. PATENT DOCUMENTS

| | | | | |
|---|---|---|---|---|
| 10,408,543 | B2 * | 9/2019 | Barfknecht | F25B 39/04 |
| 10,449,832 | B2 * | 10/2019 | Lee | F28D 9/0043 |
| 10,473,209 | B2 * | 11/2019 | Zou | F28D 9/005 |
| 2004/0112579 | A1 * | 6/2004 | Strahle | F28D 9/005 165/166 |
| 2006/0053833 | A1 * | 3/2006 | Martins | F28D 9/005 62/507 |
| 2012/0234523 | A1 * | 9/2012 | Jouanny | F28D 9/0093 165/166 |
| 2017/0038151 | A1 * | 2/2017 | Noda | B60H 1/32 |
| 2017/0122669 | A1 * | 5/2017 | Takahashi | F25B 39/04 |
| 2017/0131044 | A1 * | 5/2017 | Martins | F28F 9/14 |

FOREIGN PATENT DOCUMENTS

| | | | | |
|---|---|---|---|---|
| JP | 2016090217 | A | 5/2016 | |
| KR | 10-2012-0061534 | A | 6/2012 | |
| WO | WO-2010060657 | A1 * | 6/2010 | F28D 9/005 |
| WO | 2010108907 | A1 | 9/2010 | |

* cited by examiner

CONDENSER

CROSS-REFERENCE TO RELATED APPLICATIONS

This application claims priority under 35 U.S.C. § 119 to Korean Patent Application No. 10-2017-0108725, filed on Aug. 28, 2017, Korean Patent Application No. 10-2018-0070622, filed on Jun. 20, 2018 and Korean Patent Application No. 10-2018-0073424, filed on Jun. 26, 2018 in the Korean Intellectual Property Office, the disclosure of which is incorporated herein by reference in its entirety.

TECHNICAL FIELD

The present invention relates to a condenser, and more particularly, to a condenser in which a configuration and an assembly are simplified by forming a condensation region in which plates are stacked and refrigerant is condensed and a super cooling region in which the refrigerant is super-cooled, arranging a connection plate to which a gas-liquid separator is coupled between the condensation region and the super cooling region, and forming the refrigerant and cooling water to flow between the condensation region and the super cooling region, in a water cooling type condenser.

BACKGROUND

In general, in a refrigeration cycle of a vehicular air conditioner, an actual cooling action is generated by an evaporator in which a heat exchange medium in a liquid state absorbs heat as much as evaporation heat on the periphery and is vaporized.

A heat exchange medium in a gas state, which flows into a compressor from the evaporator is compressed at a high temperature and a high pressure in the compressor, and liquefied heat is discharged to the periphery in the process of liquefaction while the compressed gaseous heat exchange medium passes through the condenser and the liquefied heat exchange medium passes through an expansion valve again and becomes a low-temperature and low-pressure humidified vapor state and then flows into the evaporator again to be vaporized to form a cycle.

That is, the condenser may be formed in an air cooling type using air and a water cooling type using liquid as the heat exchange medium for cooling the refrigerant in which high-temperature and high-pressure gaseous refrigerant flows into the condenser and condensed in the liquid state and discharged while the liquefied heat is discharged by heat exchange.

FIG. 1 is a diagram illustrating a water cooling type condenser 10 in the related art, in which a plate type heat exchanger in which a plurality of plates 20 are stacked may be used.

The water cooling type condenser 10 in the related art is formed to include a first flow unit 21 and a second flow unit 22 in which a plurality of plates 20 is stacked and a first heat exchange medium and a second heat exchange medium flow, respectively, a first inlet pipe 31 and a first outlet pipe 32 in which the first heat exchange medium is introduced/discharged, a second inlet pipe 41 and a second outlet pipe 42 in which the second heat exchange medium is introduced/discharged, a gas-liquid separator 50 separating the first heat exchange medium into a gaseous heat exchange medium and a liquid heat exchange medium, and a first connection pipe 51 connecting a condensation region of the first flow unit 21 and the gas-liquid separator 50 and a second connection pipe 52 connecting the liquid-gas separator and a super cooling region of the first flow unit 21.

In the water cooling type condenser 10, the first heat exchange medium which is introduced through the first inlet pipe 31 flows in the condensation region of the first flow unit 21, moves to the gas-liquid separator 50 through the first connection pipe 51, flows in the super cooling region of the first flow unit 21 through the second connection pipe 52 again, and thereafter, is discharged through the first outlet pipe 32.

In this case, the second heat exchange medium is introduced through the second inlet pipe 41 and flows in the second flow unit 22 formed alternatively with the first flow unit 21, and cools the first heat exchange medium.

In this case, the water cooling type condenser 10 needs to include the first connection pipe 51 that introduces the refrigerant into the gas-liquid separator and separates the introduced refrigerant into gas and liquid and the second connection pipe 52 discharging the gas-liquid separated refrigerant, and a configuration of the water cooling type condenser 10 becomes complicated, and assembly efficiency of the condenser for the complicated configuration deteriorates.

RELATED ART DOCUMENT

Patent Document

Korean Patent Laid-Open Publication No. 2012-0061534

SUMMARY

An exemplary embodiment of the present invention is directed to providing a condenser in which a configuration and an assembly are simplified by forming a condensation region in which plates are stacked and refrigerant is condensed and a super cooling region in which the refrigerant is super-cooled, arranging a connection plate to which a gas-liquid separator is coupled between the condensation region and the super cooling region, and forming the refrigerant and cooling water to flow between the condensation region and the super cooling region, in a water cooling type condenser.

A condenser according to the present invention includes: a condensation region in which refrigerant is condensed by using cooling water; a super cooling region super-cooling the refrigerant condensed by using the cooling water; a connection plate disposed between the condensation region and the super cooling region in a longitudinal direction and formed to allow the condensation region and the super cooling region to communicate with each other; and a gas-liquid separator provided at one side of a width direction in communication with the connection plate, gas-liquid separating the cooling water introduced from the condensation region, and discharging the gas-liquid separated refrigerant to the super cooling region.

Further, in the condensation region, a plurality of first plates and second plates may be alternatively stacked in a longitudinal direction and thus, a cooling water flow unit in which the cooling water flows and a refrigerant flow unit in which the refrigerant flows may be alternatively formed, and in the super cooling region, the plurality of first plates and second plates may be alternatively stacked in the longitudinal direction and thus, the cooling water flow unit in which the cooling water flows and the refrigerant flow unit in which the refrigerant flows may be alternatively formed.

In addition, the connection plate may include a first connection plate, and the first connection plate may include a connection plate body formed to be coupled with the first plate or the second plate between the condensation region and the super cooling region, a cooling water connection passage formed to be hollowed in the connection plate body so that the cooling water flow units of the condensation region and the super cooling flow unit communicate with each other, and a refrigerant flow passage including a refrigerant inflow passage formed in the connection plate body and allowing the refrigerant flow unit of the condensation region and the gas-liquid separator to communicate with each other and a refrigerant outflow passage allowing the gas-liquid separator and the refrigerant flow unit of the super cooling region to communicate with each other.

Further, the condensation region may include a first condensation region and a second condensation region partitioned in a longitudinal direction, and the first condensation region and the second condensation region may be connected to each other and a progress direction of a fluid in the first condensation region may be opposite to the progress direction of the fluid in the second condensation region.

In addition, the connection plate may include a second connection plate internally hollowed and formed to fix side surfaces of the condensation region and the super cooling region and including a pipe which connects the condensation region, the gas-liquid separator, and the super cooling region and in which the cooling water and the refrigerant flow.

Moreover, the first plate and the second plate may include a refrigerant inflow/outflow hole and a refrigerant flow hole which are hollowed so as for the refrigerant to flow in communication between the refrigerant flow units formed alternately in a stacking direction, and a cooling water inflow/outflow hole and a cooling water flow hole which are hollowed so as for the cooling water to flow in communication with the cooling water flow units alternatively formed in the stacking direction.

Further, the refrigerant inflow/outflow hole may have a first protrusion which protrudes to the cooling water flow unit formed on a circumference thereof, the refrigerant flow hole may have a second protrusion which protrudes to the cooling water flow unit formed on the circumference thereof, the cooling water inflow/outflow hole may have a third protrusion which protrudes to the refrigerant flow unit formed on the circumference thereof, and the cooling water flow hole may have a fourth protrusion which protrudes to the refrigerant flow unit formed on the circumference thereof.

In addition, the gas-liquid separator may include a refrigerant inflow unit into which the refrigerant passing through the condensation region is introduced, and a refrigerant outflow unit discharging the gas-liquid separated refrigerant to the super cooling region.

Further, the condensation region may further include a first partition plate which is formed in the middle of the longitudinal direction and partitions the condensation region into the first condensation region and the second condensation region and has a first connector connecting the refrigerant flow units of the first condensation region and the second condensation region at one side in a height direction.

In addition, the condensation region may further include a second partition plate which partitions the first condensation region or the second condensation region.

Further, a length of the first condensation region may be larger than that of the second condensation region.

In addition, the gas-liquid separator may include a refrigerant inflow unit into which the refrigerant passing through the second condensation region is introduced, and a refrigerant outflow unit discharging the gas-liquid separated refrigerant to the super cooling region.

Further, a part at which the refrigerant is discharged from the second condensation region and an inlet of the refrigerant inflow unit may be formed at the same height as each other.

Further, the second connection plate may include a connection plate body having an internal hollow shape and formed to be coupled with the first plate or the second plate between the condensation region and the super cooling region, a cooling water connection pipe provided in the connection plate body and connecting the cooling water flow unit, and a refrigerant connection pipe provided in the connection plate body and connecting the refrigerant flow unit and the gas-liquid separator.

In addition, the refrigerant connection pipe may include a refrigerant flow pipe connected with the refrigerant flow unit, and a connection pipe formed to be coupled with the side surface of the refrigerant flow pipe and formed to be coupled with the gas-liquid separator.

Further, the second connection plate may have each of the connection plate body, the cooling water connection pipe, the refrigerant flow pipe, and the connection pipe, which are formed to be coupled with each other.

In addition, the refrigerant flow pipe may have a closed shape inward in the longitudinal direction, and a refrigerant flow pipe hole formed to penetrate so as to couple the side surface of the refrigerant flow pipe to the connection pipe.

Further, the first connection plate may further include a first gas-liquid separator coupling portion having an opened shape so as to cover a part of the gas-liquid separator and coupled with the gas-liquid separator positioned at one side in the width direction, and a first auxiliary fixation unit formed at the other side in the width direction and formed to be coupled with the side surface of the first plate or the second plate.

Further, the second connection plate may further include a second gas-liquid separator coupling portion having an opened shape so as to cover a part of the gas-liquid separator and coupled with the gas-liquid separator is coupled and positioned at one side in the width direction, and a second auxiliary fixation unit formed at the other side in the width direction and formed to be coupled with the side surface of the first plate or the second plate.

In addition, the condenser may further include a bracket unit fixing the condensation region and the super cooling region which are selected.

DETAILED DESCRIPTION OF EMBODIMENTS

Hereinafter, a condenser according to the present invention described above will be described in detail with reference to the accompanying drawings.

First Exemplary Embodiment

Figure 1:
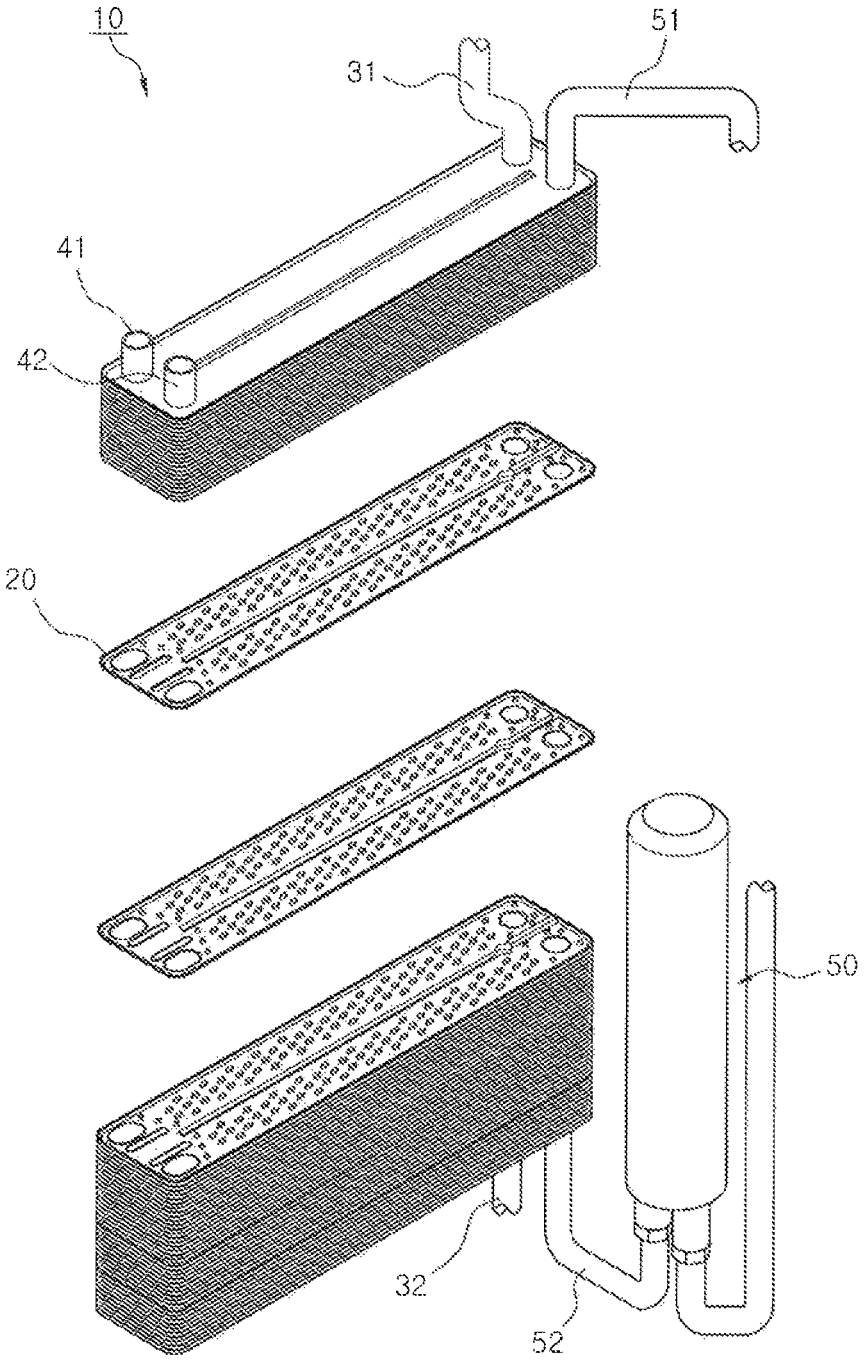
FIG. 1 is a diagram illustrating a condenser in the related art.
Figure 2:
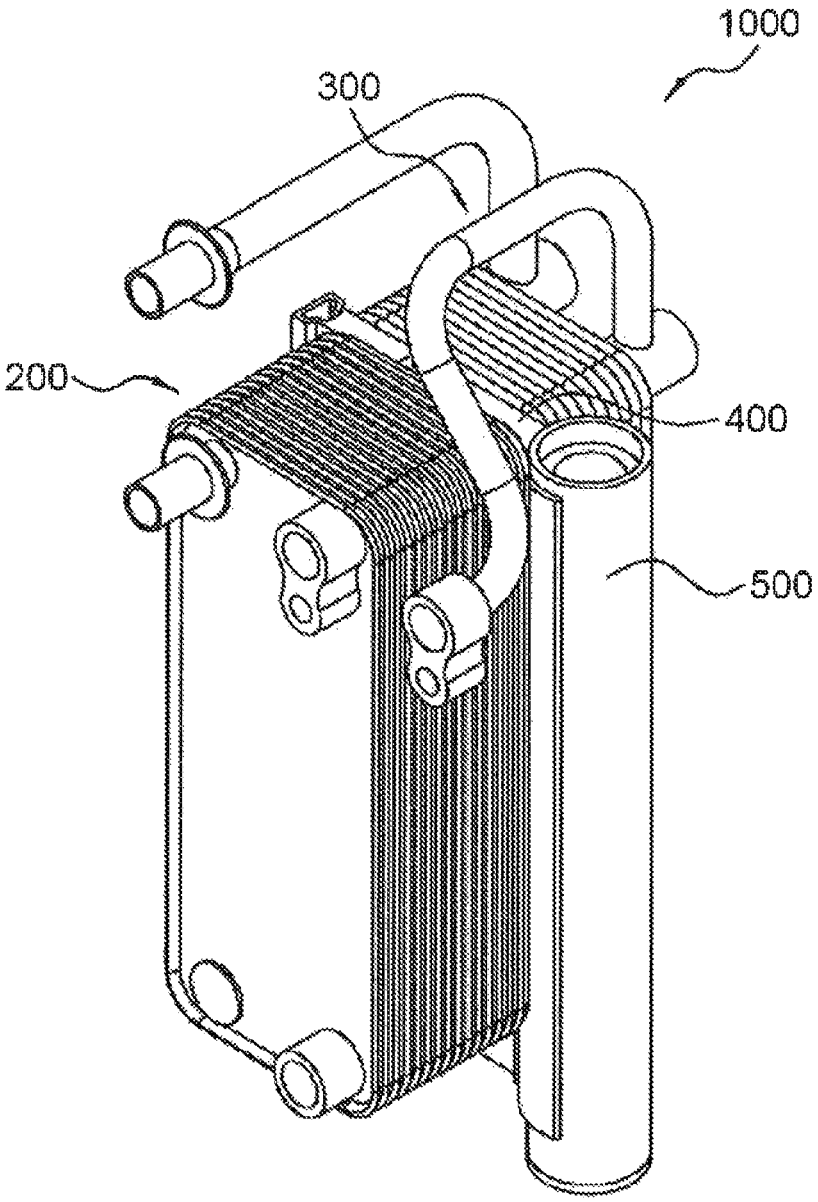
FIG. 2 is a diagram illustrating a perspective view of a condenser according to a first exemplary embodiment of the present invention.
Figure 3:
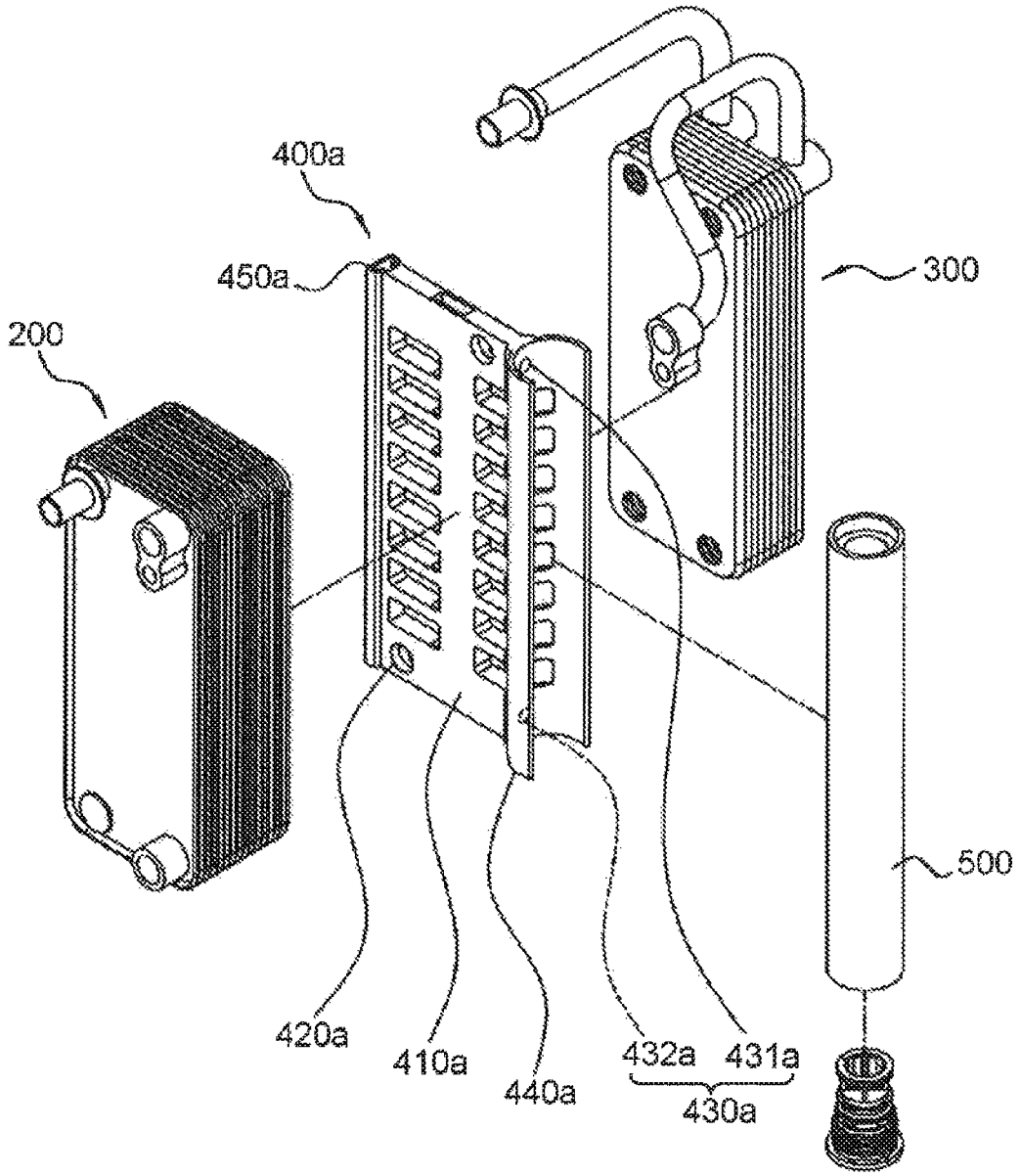
FIG. 3 is a diagram illustrating an exploded perspective view of the condenser according to the first exemplary embodiment of the present invention.

FIG. 2 is a diagram illustrating a perspective view of a condenser according to a first exemplary embodiment of the present invention and FIG. 3 is a diagram illustrating an exploded perspective view of the condenser according to the first exemplary embodiment of the present invention.

Referring to FIGS. 2 to 3, the condenser 1000 according to the first exemplary embodiment of the present invention generally includes a condensation region 200 in which refrigerant is condensed, a super cooling region 300 in which the refrigerant is super-cooled, a connection plate 400 connected so as to allow the condensation region 200 and the super cooling region 300 to be in communication with each other, and a gas-liquid separator 500 positioned in the connection plate.

In the condensation region 200, a plurality of first plates 110 and second plates 120 are alternatively stacked in a longitudinal direction and thus, a cooling water flow unit 130 in which cooling water flows and a refrigerant flow unit 140 in which the refrigerant flows may be alternatively formed in a space between the first plate 110 and the second plate 120, and the refrigerant is preferentially introduced and the refrigerant is condensed.

In the super cooling region 300, the plurality of first plates 110 and second plates 120 are alternatively stacked in the longitudinal direction and thus, the cooling water flow unit 130 in which the cooling water flows and the refrigerant flow unit 140 in which the refrigerant flows may be alternatively formed in the space between the first plate 110 and the second plate 120, and the cooling water is preferentially introduced and the refrigerant is super-cooled.

The connection plate 400 is disposed between the condensation region 200 and the super cooling region 300 in the longitudinal direction and formed to allow the condensation region 200 and the super cooling region 300 to be in communication with each other, the cooling water and the refrigerant in the condensation region 200 and the super cooling region 300 may be made to flow to be in communication with each other.

The gas-liquid separator 500 is provided on one side of a width direction in communication with the connection plate 400 and includes a refrigerant introduction unit into which the refrigerant flows and is condensed in the condensation region 200 and a refrigerant discharge unit discharging the gas-liquid separated refrigerant to the super cooling region 300.

That is, in the condenser 1000 according to an exemplary embodiment of the present invention, the refrigerant is preferentially introduced into the condensation region 200 and is heat-exchanged with the cooling water, thereby condensing the refrigerant and the condensed refrigerant is gas-liquid separated by the gas-liquid separator 500 and thereafter, flows to the super cooling region 300 and is heat-exchanged with the cooling water which is preferentially introduced into the super cooling region 300, thereby super-cooling the refrigerant.

Contrary to the refrigerant, the cooling water is preferentially introduced into the super cooling region 300 and is heat-exchanged with the refrigerant and flows in the condensation region by passing through the connection plate 400 and thereafter, is discharged to the outside.

In this case, the cooling water is preferentially supplied and flows to the super cooling region 300, and as a result, there is an advantage in that air conditioning device efficiency of a vehicle is enhanced.

Further, the connection plate 400 is disposed between the condensation region 200 and the super cooling region 300 in which the first plate 110 and the second plate 120 are stacked and is coupled with the first plate 110 or the second plate 120, and as a result, the end plate in which the first plate 110 and the second plate 120 are stacked need not be separately provided, which is advantageous in that a weight is reduced.

The condenser 1000 according to the first exemplary embodiment of the present invention will be described in more detail.

Figure 4:
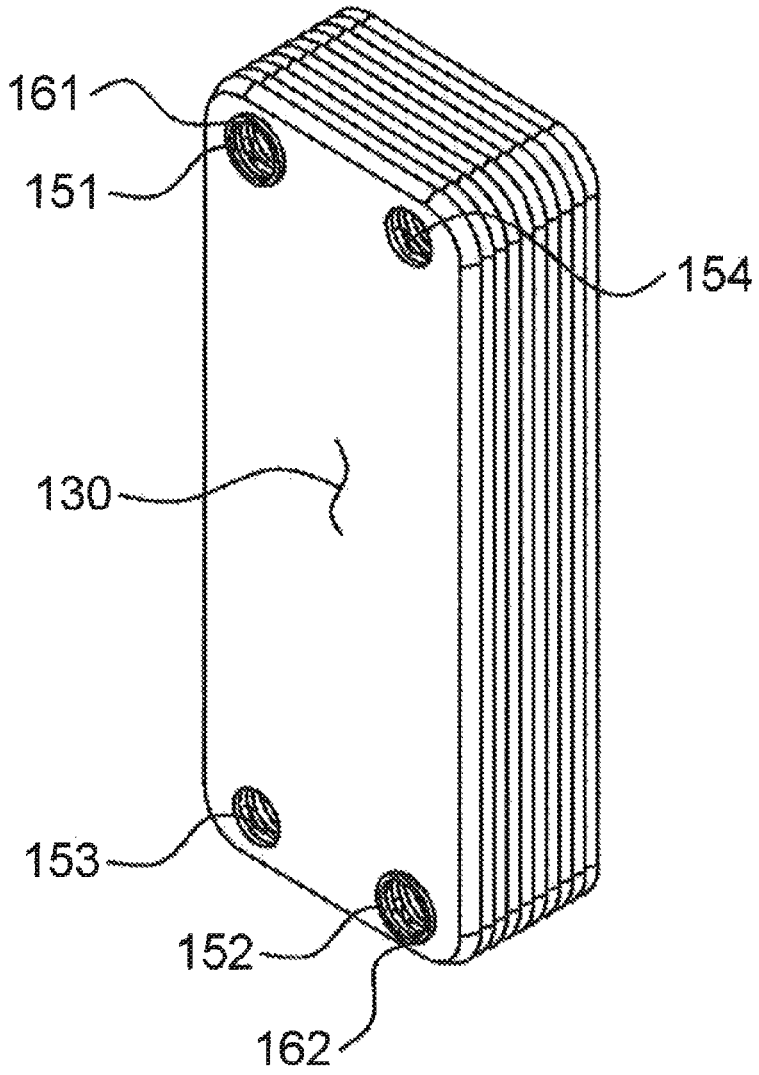
FIG. 4 is a diagram illustrating that a first plate is stacked in the condenser according to the first exemplary embodiment of the present invention.
Figure 5:
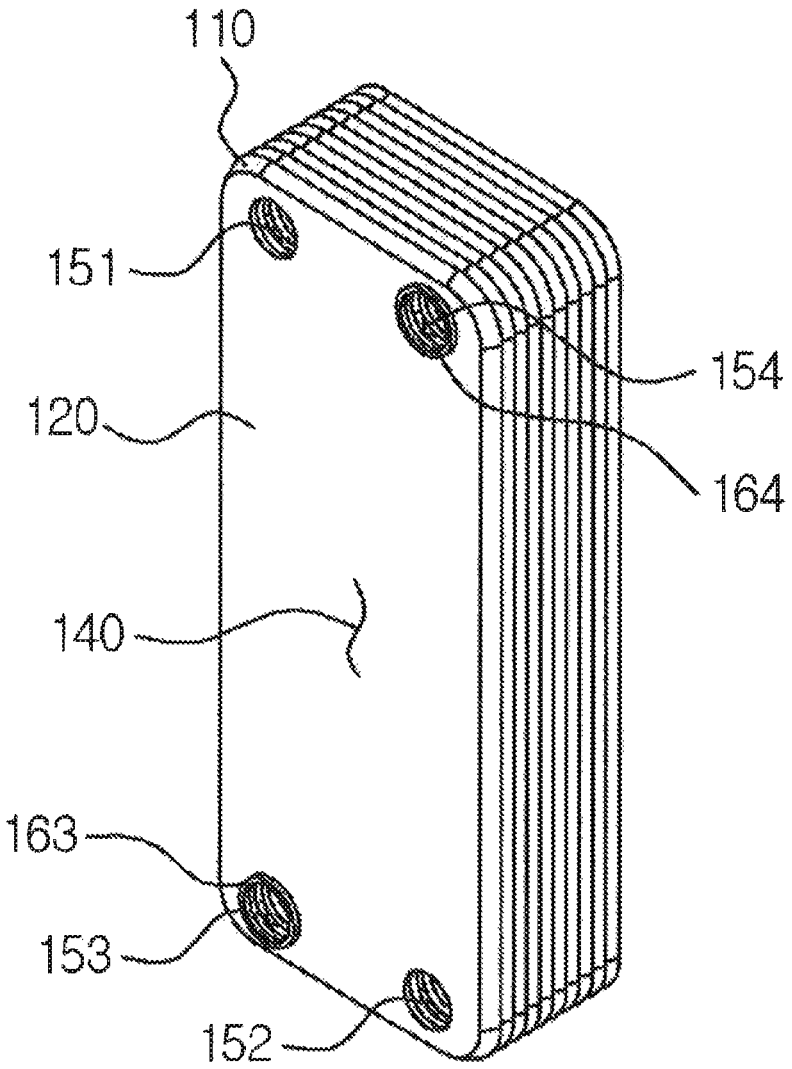
FIG. 5 is a diagram illustrating that a second plate is stacked in the condenser according to the first exemplary embodiment of the present invention.

FIG. 4 is a diagram illustrating that a first plate is stacked in the condenser according to the first exemplary embodiment of the present invention and FIG. 5 is a diagram illustrating that a second plate is stacked in the condenser according to the first exemplary embodiment of the present invention.

Referring to FIGS. 4 and 5, the first plate 110 and the second plate 120 are formed to include a refrigerant inflow/outflow hole 151 and a refrigerant flow hole 152 which are hollowed so as for the refrigerant to flow in communication between the refrigerant flow units 140 formed alternately in a stacking direction and include a cooling water inflow/outflow hole 153 and a cooling water flow hole 154 which are hollowed so as for the cooling water to flow in communication with the cooling water flow unit 130 alternatively formed in the stacking direction.

In this case, the refrigerant inflow/outflow hole 151, the refrigerant flow hole 152, the cooling water inflow/outflow hole 153, and the cooling water flow hole 154 are preferably formed to be adjacent to each corner in the first plate 110 and the second plate 120.

The refrigerant inflow/outflow hole 151 is hollowed so as for the refrigerant to flow in communication between the refrigerant flow units 140 alternatively formed in the stacking direction and a first protrusion 161 which protrudes to the cooling water flow unit 130 is formed on the circumference of the refrigerant inflow/outflow hole 151.

The refrigerant flow hole 152 is hollowed so as for the refrigerant to flow in communication between the refrigerant flow units 140 alternatively formed in the stacking direction and a second protrusion 162 which protrudes to the cooling water flow unit 130 is formed on the periphery of the refrigerant flow hole 152.

The cooling water inflow/outflow hole 153 protrudes and is hollowed so as for the cooling water to flow between the cooling water flow units 130 alternatively formed in the stacking direction and a third protrusion 163 which protrudes to the refrigerant flow unit 140 is formed on the circumference of the cooling water inflow/outflow hole 153.

The cooling water flow hole 154 is hollowed so as for the cooling water to flow between the cooling water flow units 130 alternatively formed in the stacking direction and a fourth protrusion 164 which protrudes to the refrigerant flow unit 140 is formed on the periphery of the cooling water flow hole 154.

In this case, in the condenser 1000 according to an exemplary embodiment of the present invention, a refrigerant inlet through which the refrigerant is introduced and a refrigerant outlet through which the refrigerant is discharged may be formed at the refrigerant inflow/outflow hole 151 positioned on an outermost surface in the longitudinal direction.

Moreover, a cooling water inlet through which the cooling water is introduced and a cooling water outlet through which the cooling water is discharged may be formed in at the cooling water inflow/outflow hole 153 positioned on the outermost surface in the longitudinal direction.

Of course, the condenser 1000 according to the first exemplary embodiment of the present invention preferably has a refrigerant inlet and a refrigerant outlet so that the refrigerant is preferentially introduced into the condensation region 200 and is discharged through the super cooling region 300 and preferably has a cooling water inlet and a cooling water outlet so that the cooling water is preferentially introduced into the super cooling region 300 and discharged through the condensation region 200.

Figure 6:
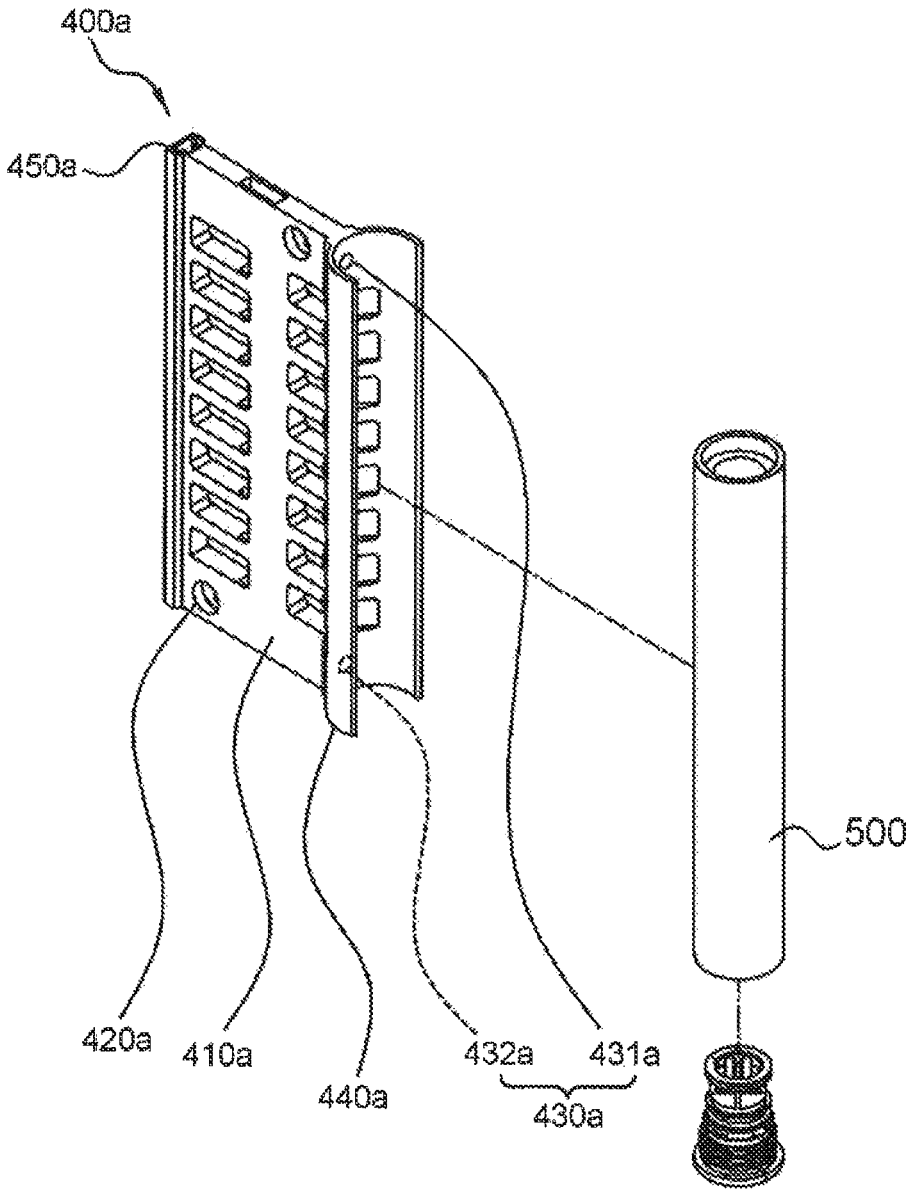
FIG. 6 is a diagram illustrating a connection plate and a gas-liquid separator of the condenser according to the first exemplary embodiment of the preset invention.

Referring to FIGS. 3 and 6, the connection plate 400 of the condenser 1000 according to the first exemplary embodiment of the present invention may be configured to include a first connection plate 400*a* and the first connection plate 400*a* may be configured to include a connection plate body 410*a*, a cooling water connection passage 429*a*, and a refrigerant flow passage 430*a*.

The connection plate body 410*a* is disposed between the condensation region 200 and the super cooling region 300 and is formed to be coupled with the first plate 110 or the second plate 120 stacked in the condensation region 200 and the super cooling region 300 and is coupled with the first plate 110 and the second plate 120 to separate the condensation region 200 and the super cooling region 300 from each other and when the connection plate body 410*a* has a shape in which coupling is easy, various shapes of exemplary embodiments are available.

The cooling water connection passage 420*a* is formed in the connection plate body 410*a* and is formed to be hollowed so that the cooling water flow units 130 of the condensation region 200 and the super cooling region 300 are in communication with each other.

More specifically, the cooling water connection passage 420*a* is formed in the connection plate body 410*a* and is formed to be hollowed so that the cooling water flow holes 154 of the condensation region 200 and the super cooling region 300 are in communication with each other.

The cooling water connection passage 420*a* needs to be formed to be coupled with the cooling water flow hole 154 and is formed to be hollowed so that the cooling water of the condensation region 200 and the super cooling region 300 may flow.

In this case, the condenser 1000 according to the first exemplary embodiment of the present invention may be formed in such a manner that since the cooling water is preferentially supplied to the super cooling region 300, the cooling water introduced into the super cooling region 300 flows to the condensation region 200 through the cooling water connection passage 420*a* of the connection plate 400 and thereafter, is discharged.

The refrigerant flow passage 430*a* is formed so that the refrigerant flow unit 140 of the condensation region 200 and the refrigerant flow units 140 of the gas-liquid separator 500 and the super cooling region 300 are in communication with each other and is generally formed to include a refrigerant inflow passage 431*a* and a refrigerant outflow passage 432*a*.

The refrigerant inflow passage 431*a* is formed inside the connection plate body 410*a* and is formed to communicate the refrigerant inflow portion 140 of the condensation region 200 and the refrigerant inlet unit of the gas-liquid separator 500, and the refrigerant inflow passage 431*a* is in communication with the refrigerant flow unit 140 of the condensation region 200 in the longitudinal direction and since the gas-liquid separator 500 is provided at one side of the width direction of the connection plate 400, the gas-liquid separator 500 is bent in the connection plate body 410*a* to be in communication with the refrigerant inflow unit of the gas-liquid separator 500.

More specifically, the refrigerant inflow passage 431*a* is formed inside the connection plate body 410*a* and is formed to communicate the refrigerant flow hole 152 of the condensation region 200 and the refrigerant inflow unit of the gas-liquid separator 500, and the refrigerant inflow passage 431*a* is in communication with the refrigerant flow hole 152 of the condensation region 200 in the longitudinal direction and since the gas-liquid separator 500 is provided at one side of the width direction of the first connection plate 400*a*, the gas-liquid separator 500 is bent in the first connection plate body 410*a* to be in communication with the refrigerant inflow unit of the gas-liquid separator 500.

The refrigerant outflow passage 432*a* is formed in the connection plate body 410*a* and is formed to be in communication with the refrigerant discharge unit of the gas-liquid separator 500 and the refrigerant flow unit 140 of the super cooling region 300, and the refrigerant outflow passage 432*a* is bent to be in communication in the connection plate body 410*a* so as to be in communication with the refrigerant outflow unit of the gas-liquid separator 500 formed at one side of the width direction of the first connection plate 400*a* and the refrigerant flow unit 140 of the super cooling region 300 formed in the longitudinal direction.

More specifically, the refrigerant outflow passage 432*a* is formed in the connection plate body 410*a* and is formed to be in communication with the refrigerant discharge unit of the gas-liquid separator 500 and the refrigerant flow hole 152 of the super cooling region 300, and the refrigerant outflow passage 432*a* is bent to be in communication so as to be in communication with the refrigerant outflow unit of the gas-liquid separator 500 formed at one side of the width direction of the first connection plate 400*a* and the refrigerant flow hole 152 of the super cooling region 300 formed in the longitudinal direction.

As described above, the condenser 1000 according to the first exemplary embodiment of the present invention includes the condensation region 200 in which the refrigerant is preferentially introduced and the super cooling region 300 in which the cooling water is preferentially introduced and flows and includes the connection plate 400 including a first connection plate 400*a* separating the condensation region 200 and the super cooling region 300 from each other, and the first connection plate 400*a* includes a connection plate body 410*a* coupled with the first plate 110 or the second plate 120 of the condensation region 200 and the super cooling region 300, a cooling connection passage 420*a* which is hollowed in the connection plate body 410*a* to allow the cooling water to flow in the super cooling region 300 and the condensation region 200, and a refrigerant flow passage 430*a* in which the refrigerant condensed in the condensation region 200 flows to the gas-liquid separator 500, is gas-liquid separated in the gas-liquid separator 500 and thereafter, the refrigerant flows to the refrigerant flow hole 152 of the super cooling region 300.

Therefore, since the end plate need not be separately provided in the first plate 110 and the second plate 120 which are stacked in the condensation region 200 and the super cooling region 300 by the connection plate body 410*a*, it is advantageous in that the weight is reduced.

Further, since the cooling water and the refrigerant may be made to be in communication with each other through the first connection plate 400*a* having a simple configuration or may be supplied to the gas-liquid separator 500, a pipe through which the refrigerant flows to the gas-liquid separator 500 may be omitted and the pipe may be replaced with the first connection plate 400*a*, and as a result, there is no fear of breakage or leakage due to an external impact and in particular, the overall configuration and shape of the condenser 1000 are simplified.

Moreover, the first connection plate 400*a* further includes a first gas-liquid separator coupling portion 440*a* having a shape in which the first gas-liquid separator coupling portion 440*a* is opened so as to cover a part of the gas-liquid separator 500 to one side of the width direction and at which the gas-liquid separator 500 is coupled and positioned.

As illustrated in the drawing, the first gas-liquid separator coupling portion 440*a* may have a shape in which the first gas-liquid separator coupling portion 440*a* is curved and opened to correspond to an outer peripheral surface of the gas-liquid separator 500 having a substantially cylindrical shape to easily fix the gas-liquid separator 500 to one side of the width direction of the first connection plate 400*a*.

That is, in the condenser 1000 according to the first exemplary embodiment of the present invention, since the gas-liquid separator 500 may be positioned and fixed to one side of the width direction through the connection plate 400 including the first connection plate 400*a*, it is advantageous in that it is easy to arrange and fix the gas-liquid separator 500, and as a result, a space in the longitudinal direction may be reduced in the vehicle with the condenser 1000.

In addition, since the first gas-liquid separator coupling portion 440*a* of the first connection plate 400*a* is positioned at a selected location of both sides of the width direction to be coupled to the gas-liquid separator 500, the first gas-liquid separator coupling portion 440*a* may be easily disposed in various vehicles with the condenser 1000, thereby applying the first gas-liquid separator coupling portion 440*a* to various vehicles.

Moreover, the first connection plate 400*a* may further include a first auxiliary fixation portion 450 which protrudes to the other side in the width direction and extends in the longitudinal direction to be coupled with a side surface of the first plate 110 or the second plate 120 of the condensation region 200 and the super cooling region 300.

The first auxiliary fixation portion 450 is formed to be coupled with the side surfaces of the first plate 110 or the second plate 120 stacked in the condensation region 200 and the super cooling region 300 to firmly couple the connection plate 400 between the condensation region 200 and the super cooling region 300, thereby preventing leakage of the refrigerant or cooling water.

Of course, the shape of the first auxiliary fixation portion 450 is not limited as long as it is easy to couple with the first plate 110 or the second plate 120 of the condensation region 200 and the super cooling region 300 and various exemplary embodiments may be made, of course.

Figure 7:
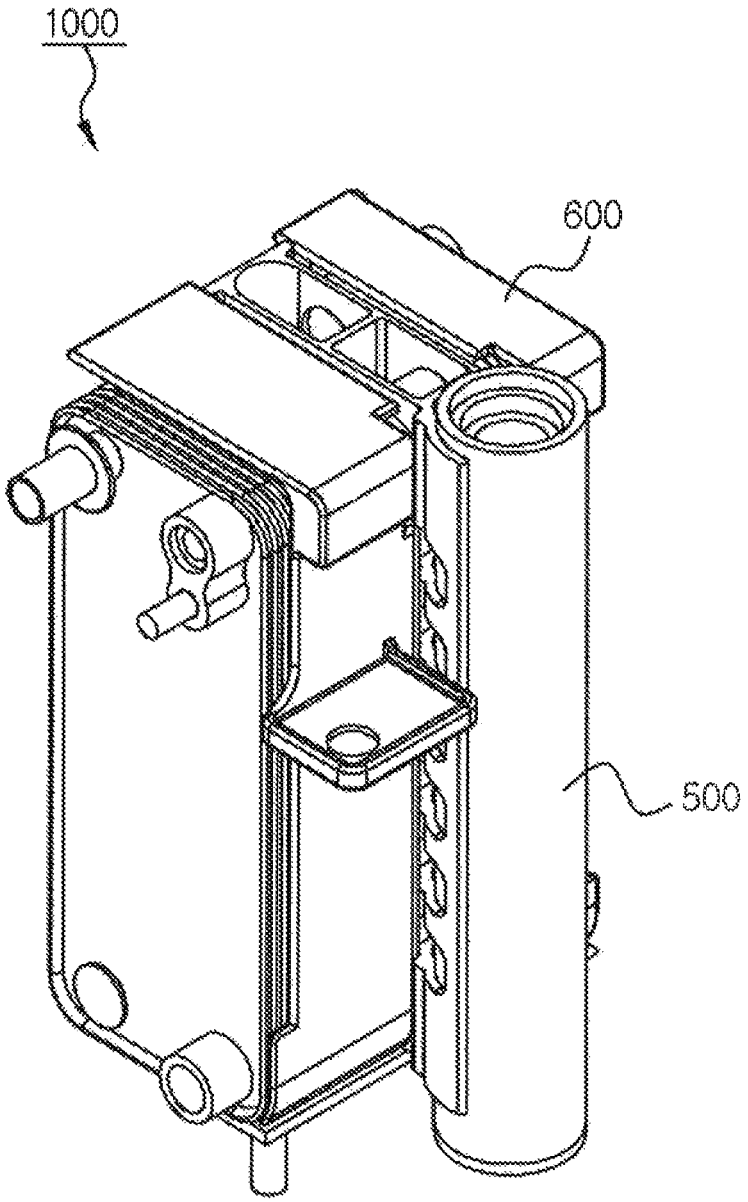
FIG. 7 is another diagram illustrating a perspective view of the condenser according to the first exemplary embodiment of the present invention.

Moreover, referring to FIG. 7, the condenser 1000 according to the first exemplary embodiment of the present invention may further include a bracket unit 600 for fixing the condensation region 200 and the super cooling region 300 which are selected.

The bracket unit 600 may fix and support the condensation region 200 and the super cooling region 300 and may have a shape for fixation to a separate location of the vehicle, that is, various exemplary embodiments may be made, and as a result, the bracket unit 600 is not limited.

Second Exemplary Embodiment

Figure 8:
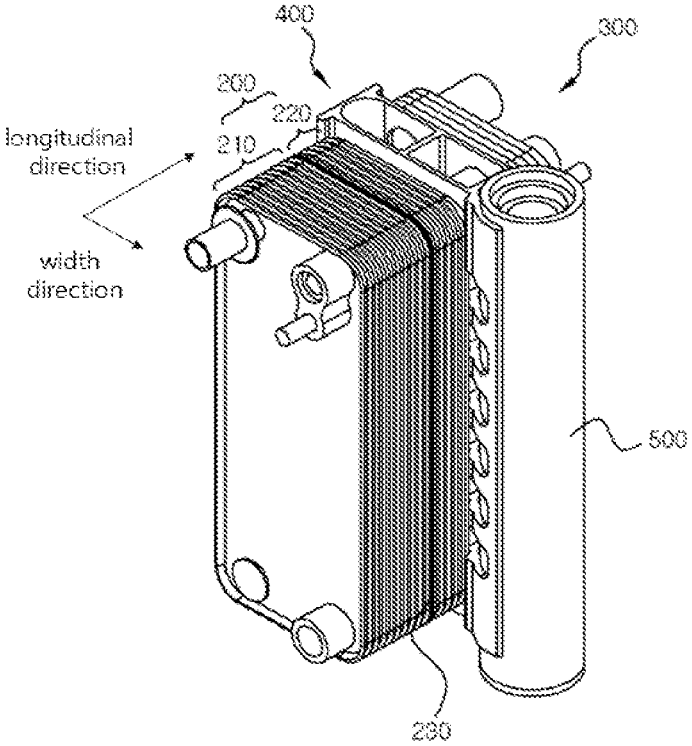
FIG. 8 is a diagram illustrating a perspective view of a condenser according to a second exemplary embodiment of the present invention.
Figure 9:
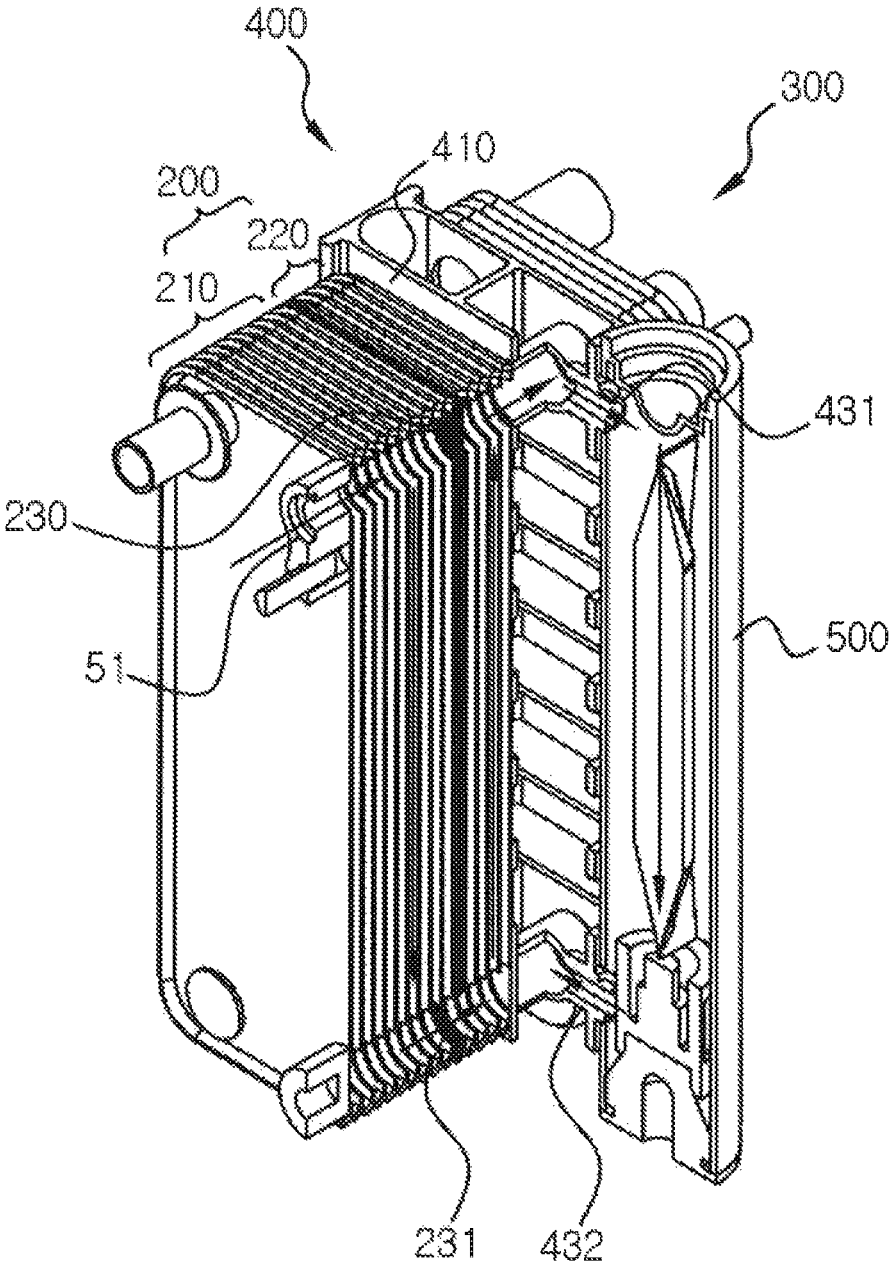
FIG. 9 is a diagram illustrates a state in which a part of the condenser is cut according to the second exemplary embodiment of the present invention.
Figure 10:
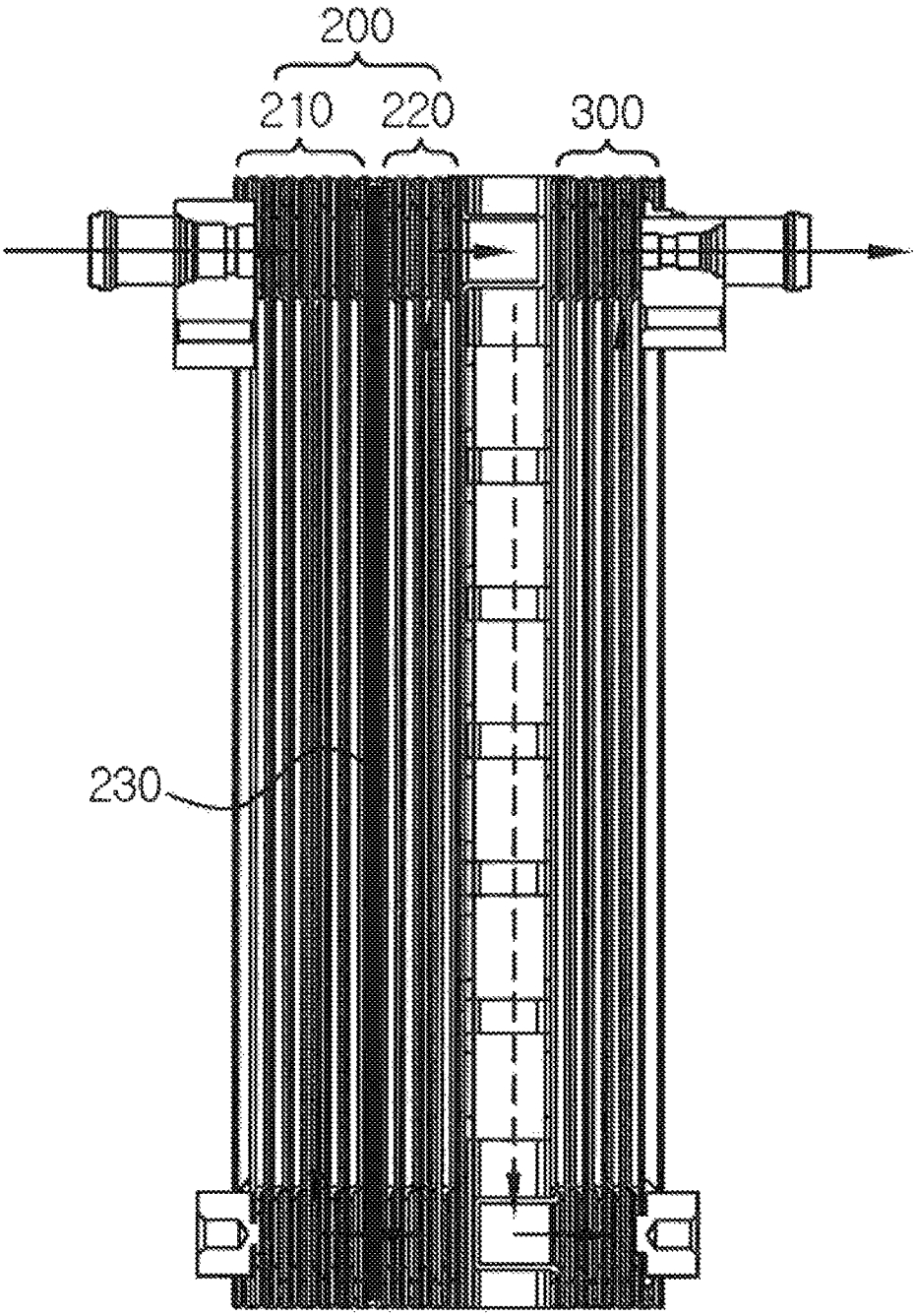
FIG. 10 is a diagram illustrating a cross-sectional view of the condenser according to the second exemplary embodiment of the present invention.

FIG. 8 is a diagram illustrating a perspective view of a condenser according to a second exemplary embodiment of the present invention, FIG. 9 is a diagram illustrates a state in which a part of the condenser is cut according to the second exemplary embodiment of the present invention, and FIG. 10 is a diagram illustrating a cross-sectional view of the condenser according to the second exemplary embodiment of the present invention.

Referring to FIGS. 8 to 10, a condensation region 200 according to a second exemplary embodiment of the present invention includes a first condensation region 210, a second condensation region 220, and a first partition plate 230.

In the first condensation region 210, multiple plates are stacked in the longitudinal direction and the cooling water flow unit in which a cooling target fluid flows and a refrigerant flow unit in which the refrigerant flows are alternatively formed.

The cooling water which flows in the cooling water flow unit may be water, air, or other fluids and in the exemplary embodiment, it is described that the cooling target fluid is water, that is, the cooling water.

In this case, a length of the first condensation region 210 may be larger than that of the second condensation region 220. That is, the first plate 110 and the second plate 120 constituting the first condensation region 210 and the second condensation region 220 are the same as each other and when the first plate 110 and the second plate 120 are stacked at the same interval from each other, the total sum of the numbers of the first and second plates 110 and 120 constituting the first condensation region 210 may be larger than the total sum of the numbers of the first and second plates 110 and 120 constituting the second condensation region 220.

The first partition plate 230 is formed in the longitudinal direction of the condensation region 200 and partitions the condensation region 200 into a first condensation region 210 and a second condensation region 220 to shield the cooling water flow unit or the refrigerant flow unit formed at one outermost side in the longitudinal direction of the first condensation region 210.

The first partition plate 230 has a first connector 231 that is connected to the refrigerant flow unit of the first condensation region 210 on the other side (lower side in the drawing) in a height direction so as to serve to a passage for moving the refrigerant of the first condensation region 210 to the second condensation region 220.

That is, the refrigerant introduced into the refrigerant flow unit inside the first condensation region 210 by a refrigerant inlet 51 moves downward in the height direction of the first condensation region 210, and then flows to the refrigerant flow unit of the second condensation region 220 through the first connector hole 231.

In this case, a flow path of the refrigerant is configured in a U-turn structure by considering the refrigerant which is condensed in the first and second condensation regions 210 and 220 and is changed in a specific volume, and as a result, a flow velocity of the refrigerant may not be lowered.

The refrigerant passing through the first condensation region 210 and the second condensation region 220 is introduced into the gas-liquid separator 500 through the connection plate 400 and then introduced into the super cooling region 300 from the gas-liquid separator 500 again and thereafter, discharged through a refrigerant outlet 52.

In an exemplary embodiment of the present invention described above, the refrigerant which is condensed and changed in the specific volume is moved in zigzag to extend the flow path through the first and second condensation regions 210 and 220 and so as to prevent the flow velocity of the refrigerant from being lowered through the U-turn structure and when necessary, a second partition plate (not illustrated) and a third condensation region (not illustrated) having the same configuration as the first partition plate 230 and the second condensation region 220 are added between the second condensation region 220 and the connection plate 400, that is, to one side of the second condensation region 220 to extend the flow path of the refrigerant.

The first plate 110 and the second plate 120 constituting the first condensation region 210 and the second condensation region 220 may be disposed so as to face the same surface.

That is, the first plate 110 and the second plate 120 may be stacked so as to be symmetrical with respect to the first partition plate 230 when viewed from the direction in which the first plate 110 and the second plate 120 are stacked and this is to prevent the flow velocity of the refrigerant passing through the refrigerant flow unit of the second condensation region 220 by passing through the refrigerant flow unit of the first condensation region 210 configured in zigzag from being lowered and for the same purpose, a portion where the refrigerant is discharged from the second condensation region 220 may be formed at the same height as a refrigerant inflow passage 431 which is a portion where the refrigerant discharged from the second condensation region 220 is introduced into the gas-liquid separator 500 through the connection plate 400.

Third Exemplary Embodiment

Figure 11:
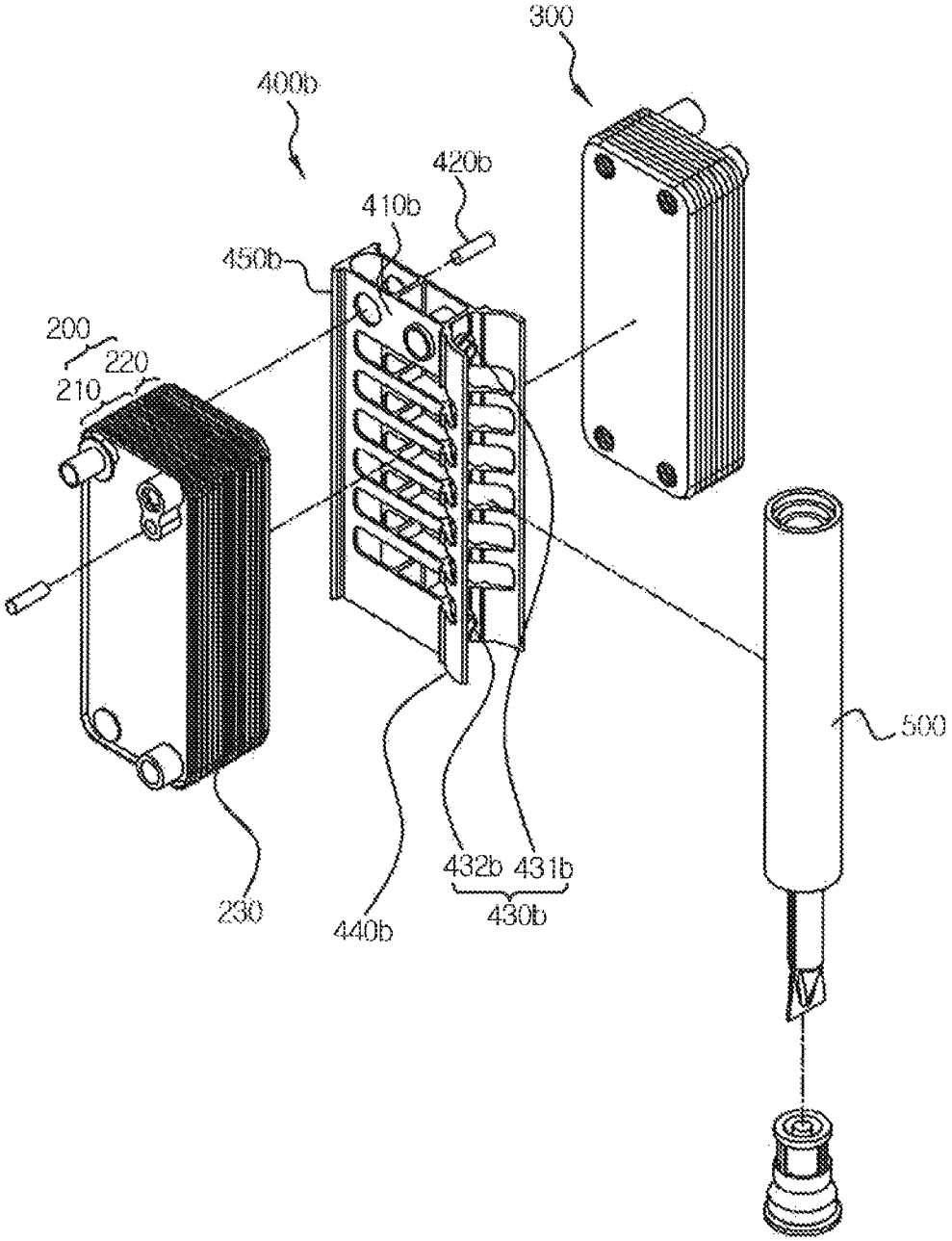
FIG. 11 is a diagram illustrating an exploded perspective view of a condenser according to a third exemplary embodiment of the present invention.
Figure 12:
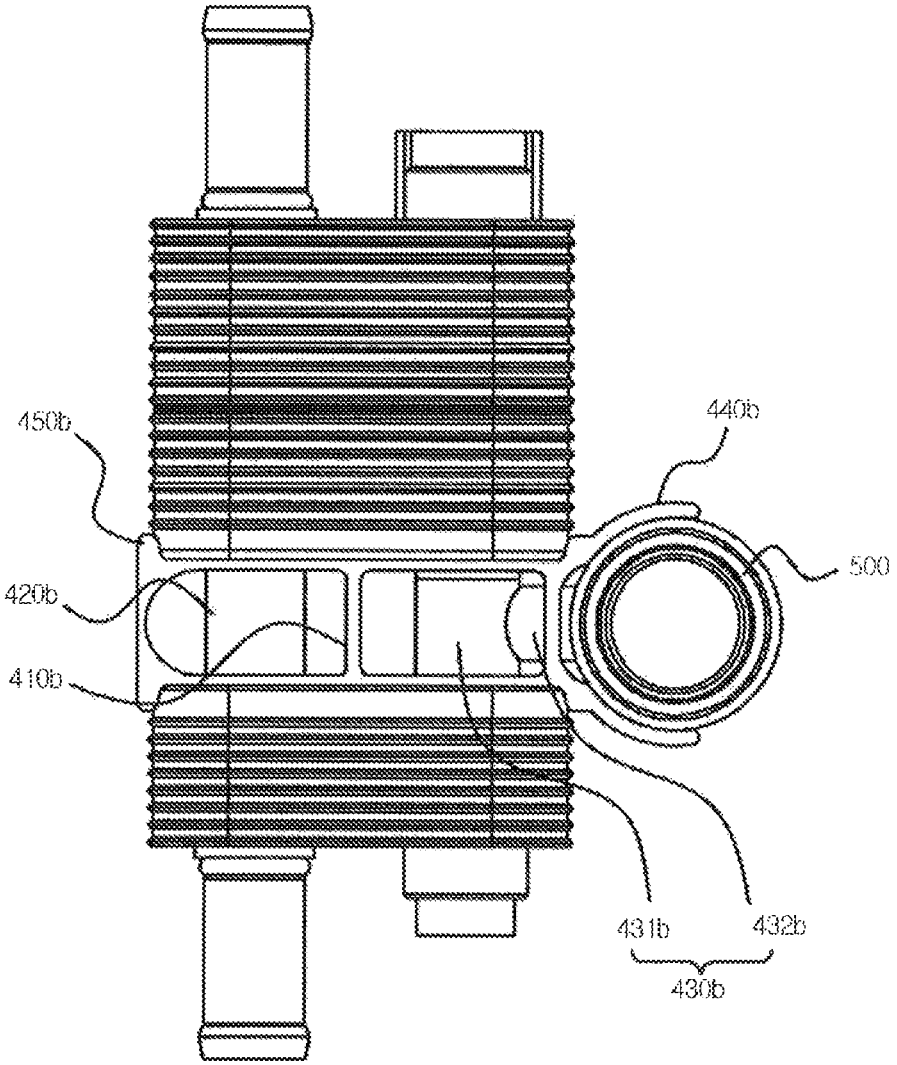
FIG. 12 is a diagram illustrating a plan view the condenser according to the third exemplary embodiment of the present invention.
Figure 13:
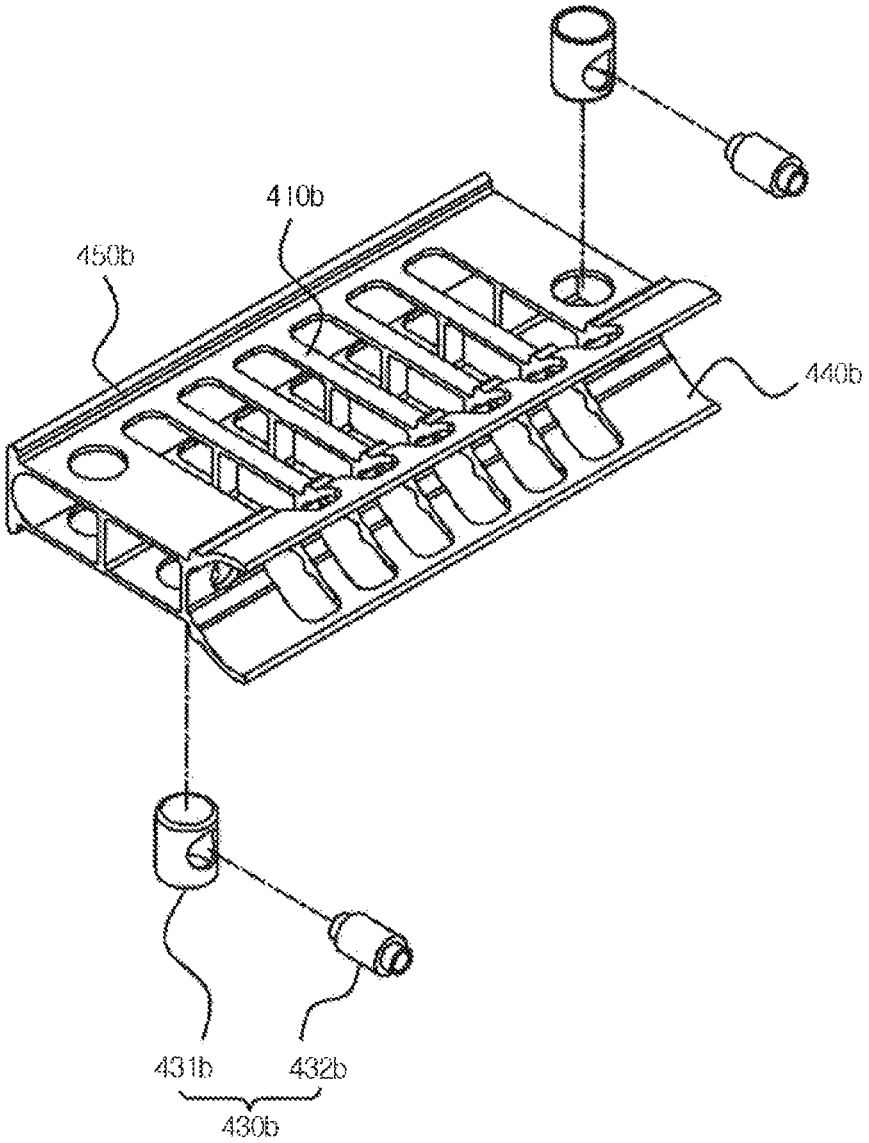
FIG. 13 is a diagram illustrating a connection plate of the condenser according to the third exemplary embodiment of the present invention.

FIG. 11 is a diagram illustrating an exploded perspective view of a condenser according to a third exemplary embodiment of the present invention, FIG. 12 is a diagram illustrating a plan view of the condenser according to the third exemplary embodiment of the present invention, and FIG. 13 is a diagram illustrating a connection plate of the condenser according to the third exemplary embodiment of the present invention.

Referring to FIGS. 11 to 13, the connection plate 400 of the condenser 1000 according to the third exemplary embodiment of the present invention includes a second connection plate **400*b* including a connection plate body 410*b* formed to be coupled with the first plate 110 or the second plate 120 between the condensation region 200 and the super cooling region 300**.

The connection plate body **410*b* of the second connection plate 400*b* may have a frame shape in which the inside is hollowed and preferably has a simple shape for minimization of the weight if the connection plate body 410*b*** has a predetermined strength.

Moreover, the second connection plate **400*b* includes a cooling water connection pipe 420*b* which is formed to be coupled to the connection plate body 410*b* and connects the cooling water flow unit 130**.

The cooling water connection pipe **420*b* has a pipe shape and is provided so as to communicate with the cooling water flow unit 130**, thereby allowing the cooling water to flow.

Moreover, the cooling water connection pipe **420*b* is formed to be coupled with the connection plate body 410*b* and is manufactured apart from the connection plate body 410*b* and it is preferable to brazing-assemble and use the cooling water connection pipe 420*b*** as necessary.

That is, the cooling water connection pipe **420*b* does not form the flow path through which the cooling water flows in the connection plate body 410*b* but flows the cooling water through the separately formed cooling water connection pipe 420*b*, and as a result, an unnecessary weight increase may be prevented and since a flow path in which the cooling water flows may not be formed in the connection plate body 410*b***, a manufacturing time is reduced.

In this case, the connection plate body **410*b* has a through hole in which the cooling water connection pipe 420*b* penetrates to connect the cooling water flow units 130** to each other.

Moreover, the second connection plate **400*b* is configured to further include a refrigerant connection pipe 430*b* including a refrigerant flow pipe 431*b* which is formed to be coupled to the connection plate body 410*b* and formed to be coupled with the refrigerant flow unit 140 in a selected direction and a connection pipe 432*b* which is formed to be coupled with the refrigerant flow pipe 431*b* and formed to be coupled with the gas-liquid separator 500**.

In this case, the refrigerant flow pipe **431*b*** is a cup shape having a closed shape inward in the longitudinal direction.

In addition, a selected side surface of the refrigerant flow pipe **431*b* is configured to include a refrigerant flow pipe hole formed to penetrate so as to be coupled with the connection pipe 432*b***.

That is, the refrigerant in the refrigerant flow unit 140 flows through the refrigerant flow pipe **431*b*, and flows the refrigerant to the gas-liquid separator 500 through the connection pipe 432*b* coupled to the refrigerant flow pipe 431*b* and on the contrary, the refrigerant discharged from the gas-liquid separator 500 flows through the connection pipe 432*b* on the other side and is discharged along the refrigerant flow pipe 431*b*** on the opposite side.

The gas-liquid separator 500 is configured to include a refrigerant inflow unit which is formed to be coupled with the connection pipe **432*b* and into which the refrigerant passing through the condensation region 200 is introduced and a refrigerant outflow unit discharging the gas-liquid separated refrigerant through the connection pipe 432*b***.

In the refrigerant connection pipe **430*b*, the refrigerant flow pipe 431*b* and the connection pipe 432*b* are manufactured apart from the connection plate body 410*b* and are coupled through brazing as necessary similarly to the cooling water connection pipe 420***b*.

That is, in the refrigerant flow pipe 431*b* and the connection pipe 432*b*, the flow path through which the refrigerant flows to the gas-liquid separator 500 is not formed in the connection plate body 410*b*, but the refrigerant flows through the refrigerant connection pipe 430*b* including the refrigerant flow pipe 431*b* and the connection pipe 432*b* which are separately manufactured, and as a result, the unnecessary weight increase may be prevented and since the flow path in which the refrigerant flows need not be formed in the connection plate body 410*b*, the manufacturing time is reduced.

As described above, the condenser 1000 according to the third exemplary embodiment of the present invention includes a condensation region 200 in which the refrigerant is preferentially introduced and flows and a super cooling region 300 in which the cooling water is preferentially introduced and flows, and includes a connection plate 400*b* separating the condensation region 200 and the super cooling region 300 from each other, and the second connection plate 400*b* includes a connection plate body 410*b* coupled with the first plate 110 or the second plate 120 of the condensation region 200 and the super cooling region 300, a cooling water connection pipe 420*b* in which the cooling water flows and which is separately manufactured and coupled with the connection plate body 410*b*, and a refrigerant connection pipe 430*b* in which the refrigerant condensed in the condensation region 200 flows to the gas-liquid separator 500 and is gas-liquid separated and thereafter, the refrigerant flows to the refrigerant flow unit 140 of the super cooling region 300 and which is separately manufactured and coupled with the connection plate body 410*b*.

Therefore, since the end plate need not be separately provided in the first plate 110 and the second plate 120 which are stacked in the condensation region 200 and the super cooling region 300 by the connection plate body 410*b*, it is advantageous in that the weight is reduced.

Moreover, the second connection plate 400*b* according to the third exemplary embodiment of the present invention further includes a second gas-liquid separator coupling portion 440*b* which has an opened shape so as to cover a part of the gas-liquid separator 500 and is coupled with the gas-liquid separator 500 positioned at one side in the width direction.

As illustrated in the drawing, the second gas-liquid separator coupling portion 440*b* may have a shape in which the first gas-liquid separator coupling portion 440*b* is curved and opened to correspond to an outer peripheral surface of the gas-liquid separator 500 having a substantially cylindrical shape to easily fix the gas-liquid separator 500 to one side of the width direction of the second connection plate 400*b*.

That is, in the condenser 1000 according to an exemplary embodiment of the present invention, since the second gas-liquid separator coupling portion 440*b* may be positioned and fixed to one side of the width direction through the second connection plate 400*b*, it is advantageous in that it is easy to arrange and fix the gas-liquid separator 500, and as a result, a space in the longitudinal direction may be reduced in the vehicle with the condenser 1000.

In addition, since the second gas-liquid separator coupling portion 440*b* of the second connection plate 400*b* is positioned at a selected location of both sides of the width direction to be coupled to the gas-liquid separator 500, the second gas-liquid separator coupling portion 440*b* may be easily disposed in various vehicles with the condenser 1000, thereby applying the second gas-liquid separator coupling portion 440*b* to various vehicles.

Moreover, the second connection plate 400*b* may further include a second auxiliary fixation portion 450*b* which protrudes to the other side in the width direction and extends in the longitudinal direction to be coupled with a side surface of the first plate 110 or the second plate 120 of the condensation region 200 and the super cooling region 300.

The second auxiliary fixation portion 450*b* is formed to be coupled with the side surfaces of the first plate 110 or the second plate 120 stacked in the condensation region 200 and the super cooling region 300 to firmly couple the second connection plate 400*b* between the condensation region 200 and the super cooling region 300, thereby preventing leakage of the refrigerant or cooling water.

Of course, the shape of the second auxiliary fixation portion 450*b* is not limited as long as it is easy to couple with the first plate 110 or the second plate 120 of the condensation region 200 and the super cooling region 300 and various exemplary embodiments may be made, of course.

A condenser according to the present invention is advantageous in that a configuration and an assembly are simplified by forming a condensation region in which plates are stacked and refrigerant is condensed and a super cooling region in which the refrigerant is supercooled, arranging a connection plate to which a gas-liquid separator is coupled between the condensation region and the super cooling region, and forming the refrigerant and cooling water to flow between the condensation region and the super cooling region.

Further, the condenser according to the present invention is advantageous in that end plates of a first plate and a second plate stacked to form a condensation region and a super cooling region can be replaced with a connection plate.

In addition, since a pipe can be deleted, in which refrigerant is introduced into and discharged from a gas-liquid separator, the configuration of the condenser is simplified and damage to the pipe can be prevented due to external shock, thereby preventing leakage of the refrigerant.

What is claimed is:

1. A condenser comprising:

a condensation region in which refrigerant is condensed by using cooling water;

a super cooling region super-cooling the refrigerant condensed by using the cooling water;

a connection plate disposed between the condensation region and the super cooling region and formed to allow the condensation region and the super cooling region to communicate with each other; and a gas-liquid separator provided in communication with the connection plate, gas-liquid separating the refrigerant introduced from the condensation region, and discharging the gas-liquid separated refrigerant to the super cooling region, wherein in the condensation region, a plurality of first plates and second plates are alternatively stacked in a longitudinal direction and thus, a cooling water flow unit in which the cooling water flows and a refrigerant flow unit in which the refrigerant flows are alternatively formed, and in the super cooling region, the plurality of first plates and second plates are alternatively stacked in the longitudinal direction and thus, the cooling water flow unit in which the cooling water flows and the refrigerant flow unit in which the refrigerant flows are alternatively formed, and, wherein the condensation region includes a first condensation region and a second condensation region partitioned in the longitudinal direction, and the first condensation region and the second condensation region are connected to each other and a progress direction of a fluid in the first condensation region is opposite to the progress direction of the fluid in the second condensation region.

2. The condenser of claim 1, wherein the connection plate includes a first connection plate, and the first connection plate includes a connection plate body formed to be coupled with the first plate or the second plate between the condensation region and the super cooling region, a cooling water connection passage formed to be hollowed in the connection plate body so that the cooling water flow units of the condensation region and the super cooling region communicate with each other, and a refrigerant flow passage including a refrigerant inflow passage formed in the connection plate body and allowing the refrigerant flow unit of the condensation region and the gas-liquid separator to communicate with each other and a refrigerant outflow passage allowing the gas-liquid separator and the refrigerant flow unit of the super cooling region to communicate with each other.

3. The condenser of claim 1, wherein the connection plate includes a second connection plate internally hollowed and formed to fix side surfaces of the condensation region and the super cooling region and including a pipe which connects the condensation region, the gas-liquid separator, and the super cooling region and in which the cooling water and the refrigerant flow.

4. The condenser of claim 1, wherein the first plate and the second plate include a refrigerant inflow/outflow hole and a refrigerant flow hole which are hollowed so as for the refrigerant to flow in communication between the refrigerant flow units formed alternately in a stacking direction, and a cooling water inflow/outflow hole and a cooling water flow hole which are hollowed so as for the cooling water to flow in communication with the cooling water flow units alternatively formed in the stacking direction.

5. The condenser of claim 4, wherein the refrigerant inflow/outflow hole has a first protrusion which protrudes to the cooling water flow unit formed on a circumference thereof, the refrigerant flow hole has a second protrusion which protrudes to the cooling water flow unit formed on the circumference thereof, the cooling water inflow/outflow hole has a third protrusion which protrudes to the refrigerant flow unit formed on the circumference thereof, and the cooling water flow hole has a fourth protrusion which protrudes to the refrigerant flow unit formed on the circumference thereof.

6. The condenser of claim 1, wherein the gas-liquid separator includes a refrigerant inflow unit into which the refrigerant passing through the condensation region is introduced, and a refrigerant outflow unit discharging the gas-liquid separated refrigerant to the super cooling region.

7. The condenser of claim 1, wherein the condensation region further includes a first partition plate which is formed in the middle of the longitudinal direction and partitions the condensation region into the first condensation region and the second condensation region and has a first connector connecting the refrigerant flow units of the first condensation region and the second condensation region at one side in a height direction.

8. The condenser of claim 7, wherein the condensation region further includes a second partition plate which partitions the first condensation region or the second condensation region.

9. The condenser of claim 1, wherein a length of the first condensation region is larger than that of the second condensation region.

10. The condenser of claim 1, wherein the gas-liquid separator includes a refrigerant inflow unit into which the refrigerant passing through the second condensation region is introduced, and a refrigerant outflow unit discharging the gas-liquid separated refrigerant to the super cooling region.

11. The condenser of claim 10, wherein a part at which the refrigerant is discharged from the second condensation region and an inlet of the refrigerant inflow unit are formed at the same height as each other.

12. The condenser of claim 3, wherein the second connection plate includes a connection plate body having an internal hollow shape and formed to be coupled with the first plate or the second plate between the condensation region and the super cooling region, a cooling water connection pipe provided in the connection plate body and connecting the cooling water flow unit, and a refrigerant connection pipe provided in the connection plate body and connecting the refrigerant flow unit and the gas-liquid separator.

13. The condenser of claim 12, wherein the refrigerant connection pipe includes a refrigerant flow pipe connected with the refrigerant flow unit, and a connection pipe formed to be coupled with the side surface of the refrigerant flow pipe and formed to be coupled with the gas-liquid separator.

14. The condenser of claim 13, wherein the second connection plate has each of the connection plate body, the cooling water connection pipe, the refrigerant flow pipe, and the connection pipe, which are formed to be coupled with each other.

15. The condenser of claim 13, wherein the refrigerant flow pipe has a closed shape inward in the longitudinal direction, and a refrigerant flow pipe hole formed to penetrate so as to couple the side surface of the refrigerant flow pipe to the connection pipe.

16. The condenser of claim 2, wherein the first connection plate further includes a first gas-liquid separator coupling portion having an opened shape so as to cover a part of the gas-liquid separator and coupled with the gas-liquid separator positioned at one side in the width direction, and a first auxiliary fixation unit formed at the other side in the width direction and formed to be coupled with the side surface of the first plate or the second plate.

17. The condenser of claim 12, wherein the second connection plate further includes a second gas-liquid separator coupling portion having an opened shape so as to cover a part of the gas-liquid separator and coupled with the gas-liquid separator is coupled and positioned at one side in the width direction, and a second auxiliary fixation unit formed at the other side in the width direction and formed to be coupled with the side surface of the first plate or the second plate.

18. The condenser of claim 1, wherein the condenser further includes a bracket unit fixing the condensation region and the super cooling region which are selected.

* * * * *